US008695819B1

(12) United States Patent
Anderson

(10) Patent No.: US 8,695,819 B1
(45) **Date of Patent: *Apr. 15, 2014**

(54) CONTAINER CAP

(75) Inventor: Michael R. Anderson, Boca Raton, FL (US)

(73) Assignee: Blast Max LLC, Reno, NV (US)

( * ) Notice: Subject to any disclaimer, the term of this patent is extended or adjusted under 35 U.S.C. 154(b) by 1340 days.

This patent is subject to a terminal disclaimer.

(21) Appl. No.: 12/471,992

(22) Filed: May 26, 2009

Related U.S. Application Data

(60) Provisional application No. 61/055,475, filed on May 23, 2008.

(51) Int. Cl.
*B65D 25/08* (2006.01)

(52) U.S. Cl.
USPC ..... 215/6; 215/227; 215/228; 206/219; 206/221; 206/459; 206/514; 604/90; 604/415

(58) Field of Classification Search
USPC ..... 206/219, 221, 459.1, 514; 215/6, 227, 215/228; 604/90
See application file for complete search history.

(56) References Cited

U.S. PATENT DOCUMENTS

| | | | | |
|---|---|---|---|---|
| 3,924,741 | A * | 12/1975 | Kachur et al. | 206/221 |
| 5,352,196 | A * | 10/1994 | Haber et al. | 604/90 |
| 7,219,796 | B2 * | 5/2007 | Anderson | 206/222 |
| 7,503,453 | B2 * | 3/2009 | Cronin et al. | 206/221 |
| 7,546,919 | B2 * | 6/2009 | Lee | 206/221 |
| 8,485,359 | B2 * | 7/2013 | Anderson | 206/459.1 |
| 2004/0104247 | A1 * | 6/2004 | Anderson | 222/83 |
| 2008/0202950 | A1 * | 8/2008 | Anderson | 206/219 |
| 2009/0308831 | A1 * | 12/2009 | Anderson | 215/227 |
| 2010/0000960 | A1 * | 1/2010 | Anderson | 215/228 |

* cited by examiner

*Primary Examiner* — Anthony Stashick
*Assistant Examiner* — Cynthia Collado
(74) *Attorney, Agent, or Firm* — Malin Haley DiMaggio & Bowen, P.A.

(57) ABSTRACT

A cap dispensing chamber to hold powder and/or liquids in a contained unit with a line of weakening, including but not limited to for bottles, pouches, cartons, cans, drums, IV bags, syringes, and any other type of container that can hold a product. The body and the plunger fits snugly with one another allowing ingredients to be stored and activated by an individual when on a as needed basis. A dust cover for allowing RFID, Nano and barcodes that can be applied during or post manufacturing or any location on or in the invention A body can be molded with a screw cap, snap lid, click-in, or by itself that can ultimately fit on any type or style container.

11 Claims, 11 Drawing Sheets

FIG. 5A
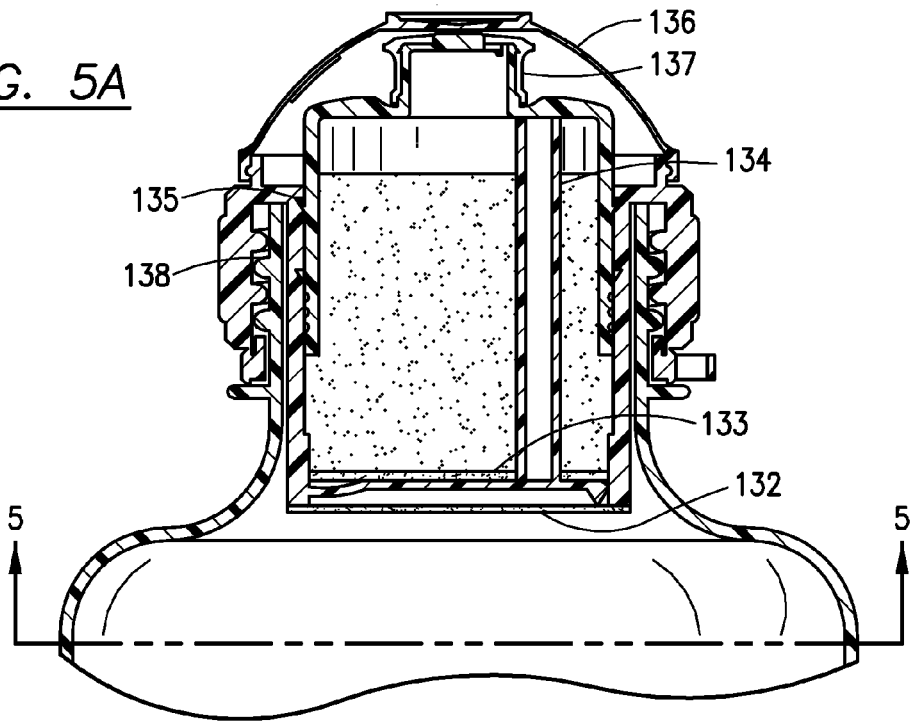
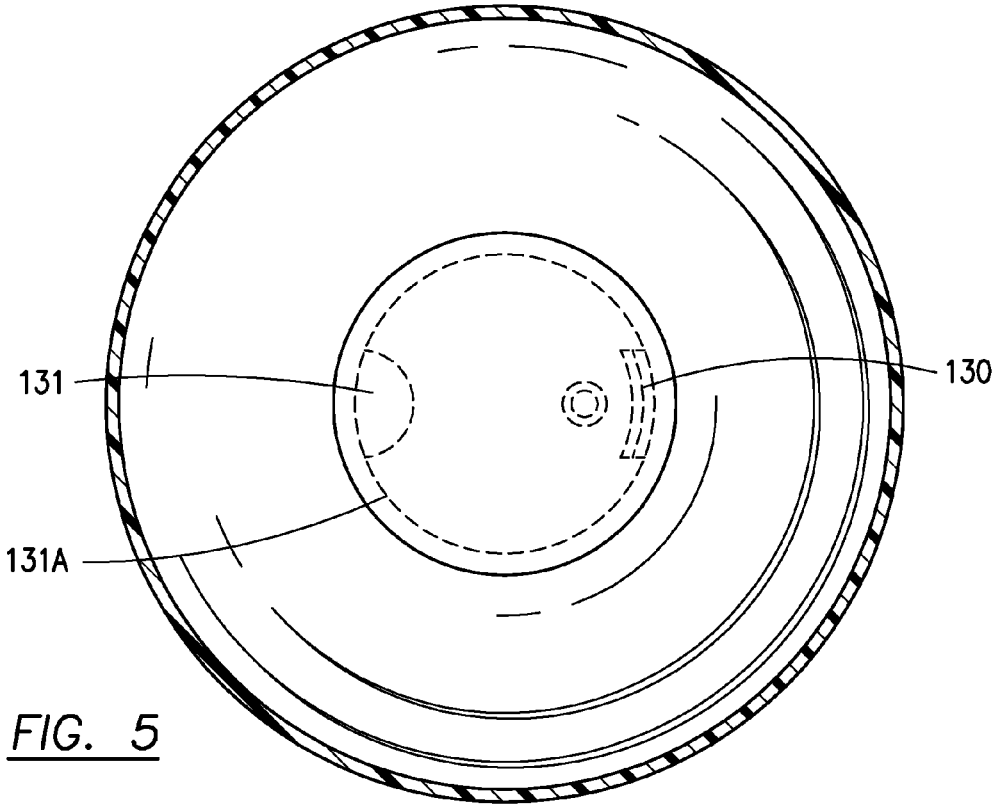
FIG. 5

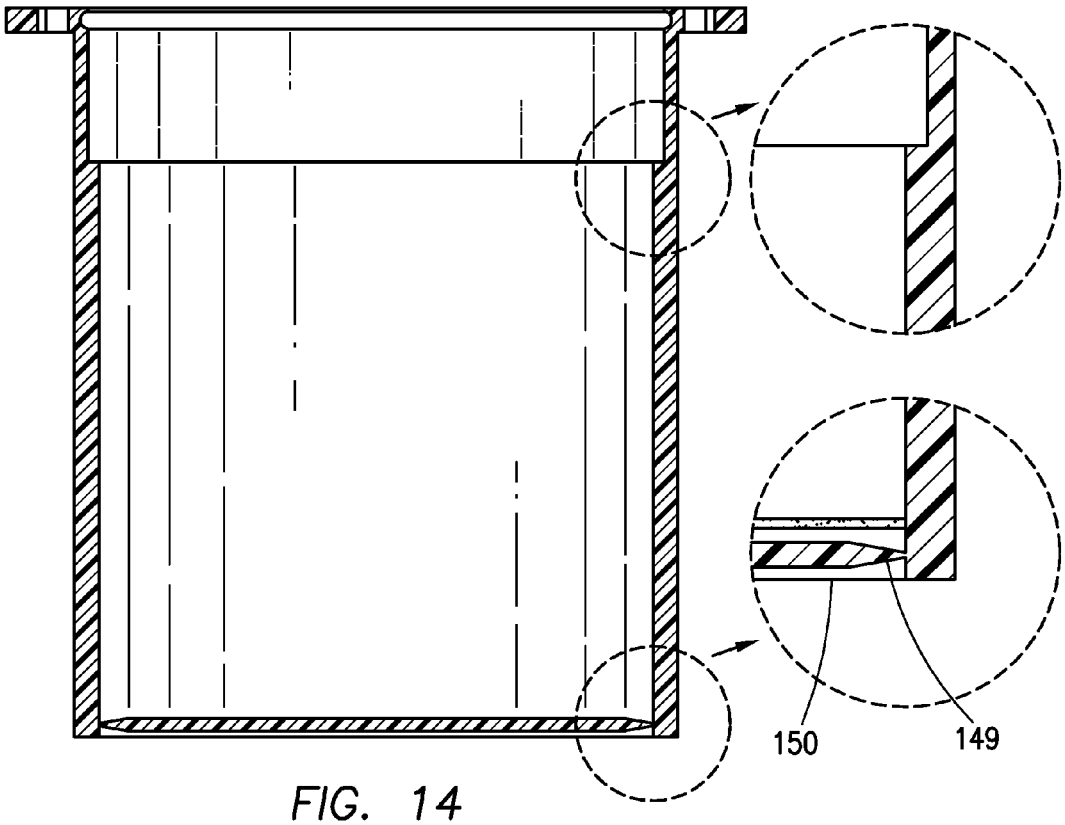
FIG. 14
FIG. 15A
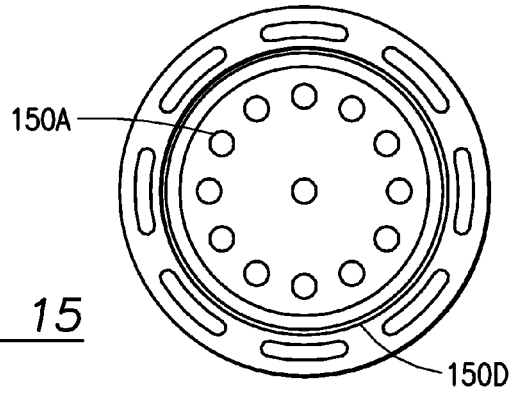
FIG. 15
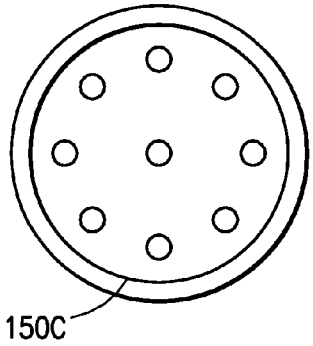

FIG. 16
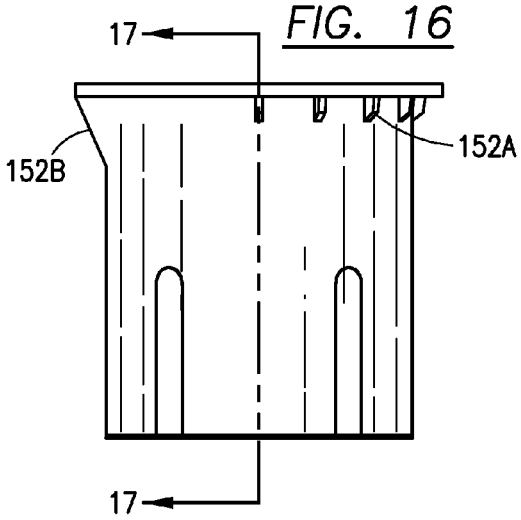
FIG. 17
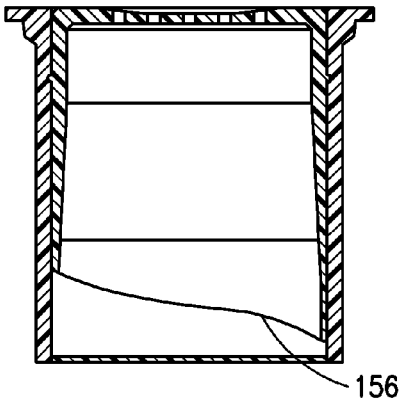
FIG. 18
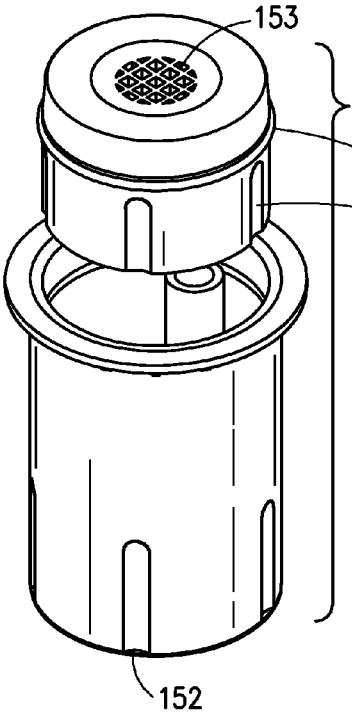
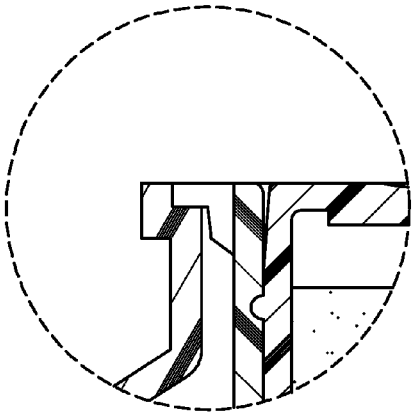
FIG. 19
FIG. 20
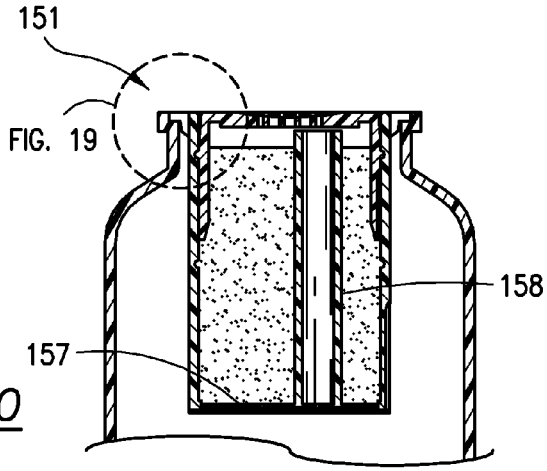

CONTAINER CAP

BACKGROUND OF THE INVENTION

1. Field of the Invention

A threaded, snapped, sealed or non threaded cap that can have one or more ingredients in the cap with a one or more chambers to hold liquid and or powder to be able to dispense ingredients when ready to use a product for freshness and to be able to have one or more ingredients to allow mixing of ingredients at time of use.

2. Description of Related Art

Normally all liquids are formulated and made knowing that the concern is shelf life and chemical reaction between different ingredients. This invention allows a product to be formulated for effectiveness rather than what has to be formulated. It also allows less toxic and material to be used in containers do to the ingredients be stored in the invention until time of use thus allowing as an example hot fill containers to be eliminated in beverage drinks and now being able to use cold fill containers using less material and chemicals for a product.

SUMMARY OF THE INVENTION

A container for mixing certain ingredients together for when ready to use for holding one or more powders and/or liquids together that can either separate so the user can attach the invention to a container or connect the invention on a container of any type. The cap insert invention is for one or more chambers in a body that can store and hold product(s); a combination of liquid and/or powder in the chamber or chambers whereas attached is a plunger mechanism that can have none or one or more holes located on the top so that any type of liquid can flow through the hole/holes once activated. The plunger can have air vents located throughout the body to allow air flow to escape so when putting the invention together in manufacturing, the air can escape so to not allow the build up of air, not to break the unit prior to a person using and for quicker mass production of the invention.

The plunger mechanism can have a multitude of designs but the preferred embodiment is with one or more holes on the top of the plunger mechanism with either smooth or slightly raised surface areas to allow flow of product after activation and also a safety seal that preferable has one or more absorbents added to it for moisture absorbent to allow the product inside to remain fresher and then to allow flow of the products after mixing together. The plunger can have raised surface areas around the holes used for the flowing of the product, around the outside of the plunger mechanism and also around the body so a seal-preferably with an absorbent material added to the seal for moisture absorbent to keep the product secure until ready to use. The invention also has one or more seal rings located on the sides of the plunger that can be of different widths with a reverse fit on the body to allow a click in type seal fit to allow the ingredients inside more stability and to have a very secure fit to each other. Also on the body the reverse rings would be duplicated on the bottom at the stop point to click in when finished activating the invention. The bottom of the body lip-ring type is slightly inward indented not to allow the plunger to fall into the container and remain fixed to the invention. The bottom of the plunger can be angled with a start tip point to more easily start the initial opening of the body bottom. The plunger can have one or more indentations running up and down to allow air to escape while assembling the product and activating so that there is a reduction of built up air. Imprinted or attached at any location on the invention is a bar code and or a RFID chip or any form of identification and information of the product including tracking devices. The invention also can be fluorinated. Ingredients can be added in the material at time of manufacturing or after for moisture/water resistance to keep the ingredients and invention more stable. In the invention at any location or imbedded in the material including attached to in any form a moisture absorbent material for keeping ingredients contained in and around the invention more shelf stable and fresh. The plunger and or body (embedded in the material or applied to) also can be color coded by way of micro encapsulation for specific products so that they are easily identified and for fraud and for specific safety reasons and turning color at certain temperatures. One or more of the seal rings can have a barb like angle thus not allowing the plunger to be able for anyone to take out with the body having a different angle not allowing the invention to be disassembled.

Also the plunger portion of the invention can have one or more holes such as a sport cap type plunger, a twist cap type plunger. Unscrewing a mechanism breaks the bottom of the invention bottom open to release a substance contained in the cap. An applicator tip type for hair care-eyes-glues-acne-or other more precise applications, a sippy cup type plunger, spill proof type plunger, a rubber type inject able top for plunger, a flip cap type of plunger or similar structure can be used. The plunger mechanism can have one or more angles on the bottom to make it easier to be activated to start the opening of the product. The invention also can have a pole mechanism in the container itself rising upwards so the plunger when depressed can start the opening as well. When depressed, the last angle portion that goes through the bottom can go further than just the even. It can go slightly further so that the bottom ripped portion is forced to stay open to prevent the bottom from holding the ingredients in after depressed to assure full disperse of the ingredients into the container. The plunger can also have a larger bubble type top to allow more ingredients to be stored when plunged, it falls into a container like a funnel motion.

The body of the invention can be inserted into a neck or attached to any type of container that holds a substance. The body has slight indentations, flanges, hinge flashes mechanisms or areas "flashes" that are more concentrated with materials at the base not to allow the plunger to fall into a container with the flanges/flashes staying attached to the body. The areas of concentrations for the flashes are close enough together so that when activated the plunger portion the plunger goes through the bottom past the end of the last area on the bottom of the cutting portion chamber area to allow full distribution of the ingredients not having the attached, now opened, bottom interfering with the ingredients that are being dispensed. The body can also have on the outside areas on the sides slightly indented areas running up and down preferably to allow air to escape while inserting the invention into a container thus allowing other reduction of pressure when adding the invention. The rim area that is stationed on the lip area can be solid so the product inside is forced to flow through upwards through the bottom of the body through the holes in the plunger. There can also be a variety of one or more holes/open areas around the surface to allow additional flow rate if necessary. Flashes can also be attached at certain angles from the lip to the body to allow the invention to be more versatile in different neck sizes to have a more snug fit to reduce or minimize movement of the invention in the container it is placed in. The body has opposite rings as the plunger located in the start position and the finished activated position. One or more of the seal rings can have a barb like angle thus not allowing the plunger to be able for anyone to take out. The body can also be molded in it's shape or any shape at any location in a container itself thus eliminating an expense of one piece and then having the plunger added after it is filled or not filled with desired product for use. Also at any location of a container there can be just an opening with a flat surface, tread or snap so that the invention can be placed in and ready for use, this also can be ultrasonically welded. The invention can also have treads on the body of the invention to enable the product to be screwed on a container. It also can have snap rings with a pull of safety ring, can be attached directly to a can-pouch-bottle-syringe-IV instruments/bags and any other type of container product. The body chamber of the invention when inserted into a neck of a container when resting on the neck or clicked into the neck can either have flow holes around the top of the rim or no holes and allow the product once activated to flow through the one or more holes in the plunger mechanism. The bottom of the chamber can have a line of weakening with flanges/flashes so after the invention has been manually activated the bottom portion can stay attached to the body. The bottom can also be open and after filled with product can have any type seal attached including desiccant imbedded or adhered to secure the products freshness until ready to use.

BRIEF DESCRIPTION OF THE DRAWINGS

FIG. 4 is a perspective view of the inner body of the container rotated 180 degrees to show the seal.

FIG. 5 is a bottom view in cross section through the horizontally disposed plane marked 17-17.

FIG. 5A is a side elevational view in cross section through the vertically disposed plane through the center of the assembled cap affixed to a container.

FIG. 14 is a side elevational view in cross section through the vertically disposed plane through the center of the outer body of yet another embodiment of the container cap.

FIGS. 15 and 15A is a top view of the container cap shown in FIG. 14.

FIG. 16 is a side elevational view of another embodiment of the container cap showing optional air vents.

FIG. 17 is a side elevational view in cross section through the vertically disposed plane of the cap shown in FIG. 16.

FIG. 18 is an exploded perspective view of the cap shown in FIG. 16.

FIG. 19 is a close up view of a groove on a container into which the cap shown in FIG. 16 rests.

FIG. 20 is a side elevational view in cross section through the vertically disposed plane of the cap shown in FIG. 16 affixed to a container showing the plunger disposed within the cap.

DETAILED DESCRIPTION

Figure 1B:
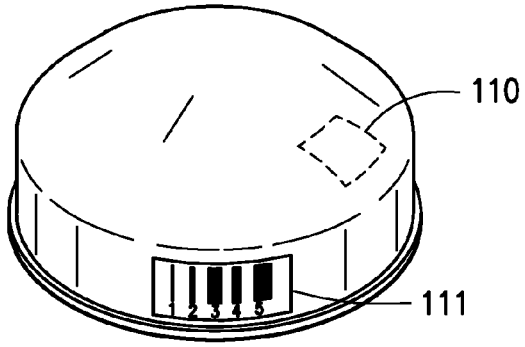
FIGS. 1, 1A and 1B is an exploded perspective view of the container cap.

The plunger mechanism can have a multitude of designs but the preferred embodiment is with one or more holes on the top of the plunger mechanism with either smooth or slightly raised surface areas to allow flow of product after activation and also a safety seal that preferable has one or more absorbents added to it for moisture absorbent to allow the product inside to remain fresher and then to allow flow of the products after mixing together. The plunger can have raised surface areas around the holes used for flowing of the product, around the outside of the plunger mechanism and also around the body so a seal-preferably with an absorbent material added to the seal for moisture absorbent to keep the product secure until ready to use. The invention also has one or more seal rings located on the sides of the plunger that can be of different widths with a reverse fit on the body to allow a click in type seal fit to allow the ingredients inside more stability and to have a very secure fit to each other. Also on the body the reverse rings would be duplicated on the bottom at the stop point to click in when finished activating the invention. The bottom of the body lip-ring type is slightly inward indented not to allow the plunger to fall into the container and remain fixed to the invention. The bottom of the plunger can be angled with a start tip point to more easily start the initial opening of the body bottom. The plunger can have one or more indentations running up and down to allow air to escape while assembly of the product and easier for activation so there is a reduction of built up air and for a better quality product. Imprinted or attached at any location of the invention can have a bar code and or a RFID chip or any form of identification and information of the product including tracking devices. The invention also can be fluorinated or ingredients added in the material at time of manufacturing or after for moisture/water resistance to keep the ingredients and invention more stable. In the invention at any location or imbedded in the material including attached to in any form a moisture absorbent material for keeping ingredients contained in and around the invention more shelf stable and fresh. The plunger and or body (embedded in the material or applied to) also can be color coded by way of micro encapsulation for specific products so that they are easily identified and for fraud and for specific safety reasons and turning color at certain temperatures. One or more of the seal rings can have a barb like angle thus not allowing the plunger to be able for anyone to take out with the body having a different angle not allowing the invention to be disassembled.

The body of the invention can be inserted into a neck or attached to any type of container that holds ingredients. The body has slight indentations, flanges, hinge flashes mechanisms or areas "flashes" that are more concentrated with materials at the based not to allow the plunger to fall into a container with the flanges/flashes staying attached to the body. The areas of concentrations for the flashes are close enough together so that when activation the plunger portion the plunger goes through the bottom past the end of the last area on the bottom of the cutting portion chamber area to allow full distribution of the ingredients not having the attached now opened bottom interfering with the ingredients that are being dispensed. The body can also have on the outside areas on the sides slightly indented areas running up and down preferably to allow air to escape while inserting the invention into a container thus allowing other reduction of pressure when adding the invention. The rim area that is stationed on the lip area can be solid so the product inside is forced to flow through upwards through the bottom of the body through the holes in the plunger. There can also be a variety of one or more holes/open areas around the surface to allow additional flow rate if necessary. Flashes can also be attached at certain angles from the lip to the body to allow the invention to be more versatile in different neck sizes to have a more snug fit to reduce or minimize movement of the invention in the container it is placed in. The body has opposite rings as the plunger located in the start position and the finished activated position. One or more of the seal rings can have a barb like angle thus not allowing the plunger to be able for anyone to take out. The body can also be molded in it's shape or any shape at any location in a container itself thus eliminating an expense of one piece and then having the plunger added after it is filled or not filled with desired product for use. Also at any location of a container there can be just an opening with a flat surface, tread or snap so that the invention can be placed in and ready for use, this also can be ultrasonically welded.

Figure 1A:
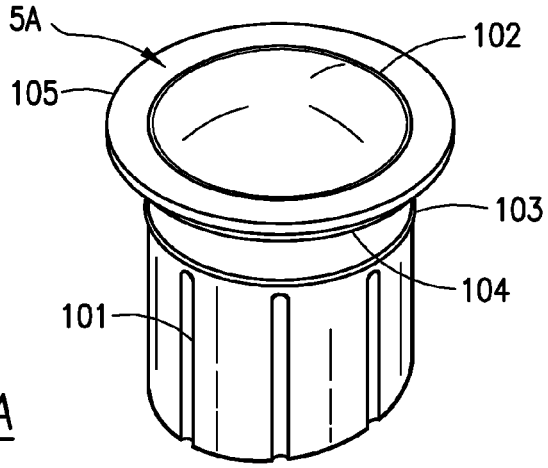
Figure 1:
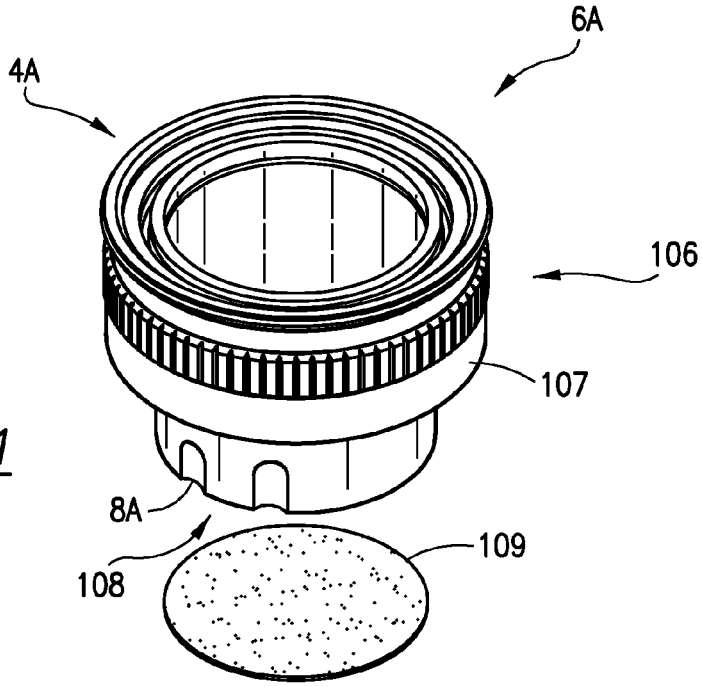
Figure 3:
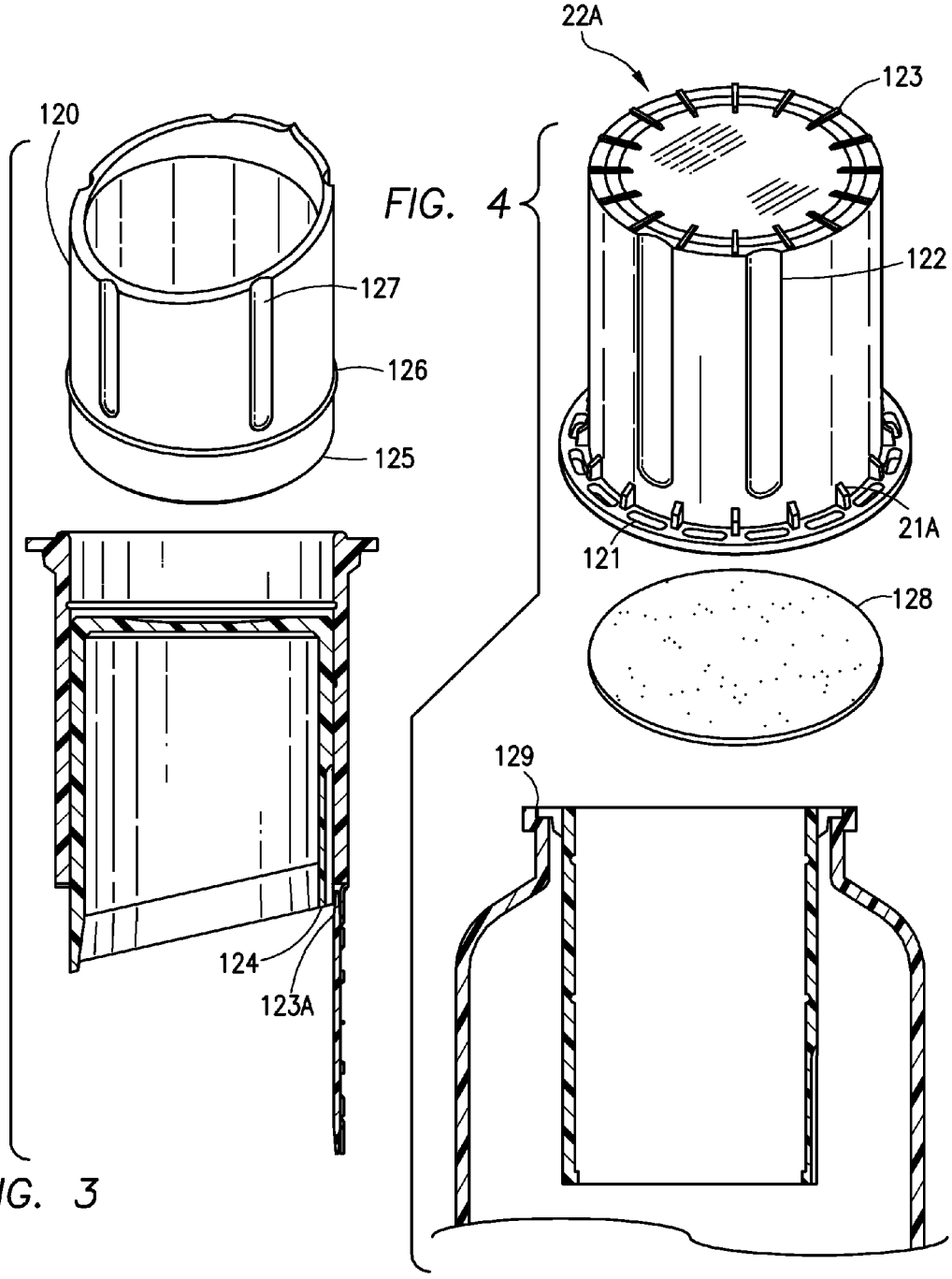
FIG. 3 is a perspective view of the plunger rotated 180 degrees to show the piercing member.

Referring now to FIG. 1, a threaded holding chamber 7 is shown, comprised of a molded plastic or other material cap body 6 with a breakaway seal, and a line of weakening bottom and/or seal with an absorbent seal material added for moisture absorbance 9. 8A shows air vents running up and down the body to allow air to escape if necessary when applying the invention to a container. There can be a variety of grooved ridges around the upper portion 6A, to allow 4 and FIG. 1B to be snapped into position. On 3 shows a raised ring area going the circumference that can have on or more including a ring with a one-way angle, so that, an individual cannot disassemble the pieces. FIGS. 4, 3, and 4A can have more than one seal ring for freshness of any product contained in the invention.

FIG. 1A shows element 3 would click into position in 4A and 4A would have the same ring positioning towards the bottom after final place of activation. Air vents 1 can run up and down throughout the outside chamber area until the seal ring to allow air to escape during assembly to eliminate build-up of pressure, as well as, easier to activate. The bottom portion of the plunger can be angled with a tip at the lowest position, allowing a start rip to easily activate the plunger. Once the invention has been activated, the plunger will go into a final stop position, slightly past the bottom surface area to allow the bottom to stay fully open, thus having full distribution of ingredients to a container, as shown in 23A and 24. The top of the plunger can be flat, or have a raised bubble like top of any size 2 to be able to have additional ingredients stored in the invention with a smaller cap size. When the plunger is assembled with the body, after it has been filled with product, there is a line of weakening along the inside rim of the entire top 5A and would break easily when activated and 5 would remain in position and not come out.

FIG. 1B shows a dust cover cap can be affixed with the safety ring 11A, to snap into position in 6A, after the invention has been filled and sealed. An RFID chip, nano technology 10 can be placed during or after manufacturing, for tracking and supplying any kind of information to the product. The 10 can be located at any location on the invention. Molded in or applied after 11, shows barcode information that also can be placed on any location or area of the invention, for easy identification, information, and/or pricing for the invention. Air vents 101 allow the product to be assembled with having the air escape from the inside to prevent pressure build up and be able to be manufactured and filled at a higher speed rate. The plunger 102 can either be flat, indented, or have a raised bubble type like area allowing the cap to be able to hold more ingredients inside. One or more seal rings 103 lock the cap into place before and after the invention is activated. Additionally a seal ring 104 fits into the bottom below container, not allowing the product to be taken out. The invention has a round rim on the top portion 105 of the invention or also can have without. Shows that the bottom portion of the invention can be molded with a screw type cap 106. In other embodiments, a snap type cap or just the holding chamber itself that can fit inside the neck of a container can be used. A safety band 107 allows for improved attachment. On the bottom can either have a line of weakening 108 so the top portion of the invention, when depressed, can unlock or rip through the bottom of the invention with staying attached to the invention. Furthermore can have a seal on the bottom for punctuation for the product to flow through. An absorbent type material 109 attached to an adhesive, bag, or by any other means, in either portion of the invention to absorb moisture. An RFID/nano chip device 110 can be added to any location of the invention for tracking and/or to store information. The can can have imprinted, by any means, a barcode 111 for processing of information at any location of the invention.

Figure 2:
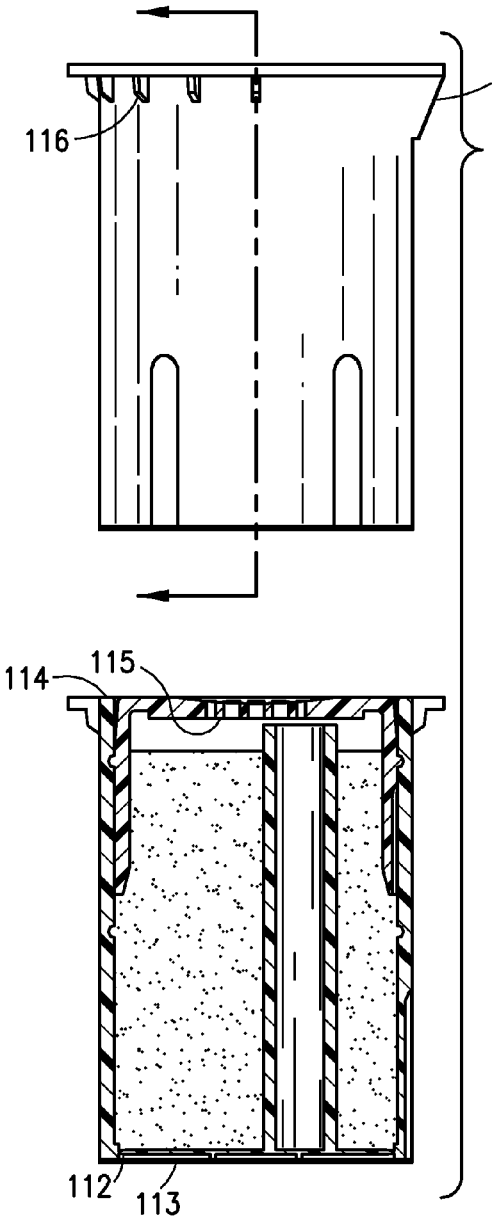
FIG. 2 is a side elevational view in cross section through the vertically disposed plane through the center of the inner body of the container cap.

FIG. 2 shows an exploded side and middle section view of flashes and flanges under the upper-rim portion to better stabilize the positioning of the invention, when placed into a container. Furthermore it can have a flanged area towards the top that flashes outward to secure securely fit in the inside neck of a container. Also on the outside area of the body running up and down there can be slight indentations, allowing air to escape during placement of the invention into a container. The plunger mechanism can have seal rings on the assembled position, and below, after activated on the open position with the bottom portion of the body.

Figure 2A:
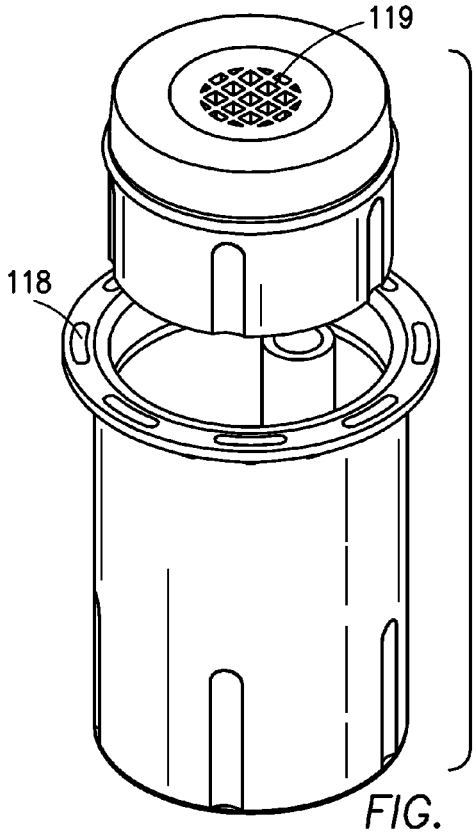
FIG. 2A is an exploded perspective view of the inner body of the container cap.

FIG. 2A shows a top angle front exploded view of the plunger mechanism with one or more holes, on top, to allow a flow of material/ingredients after activated to flow through the bottom, upwards, through the top hole or holes. On the plunger there are one or more rings that slightly protrude, outwards or inwards, with the exact opposite dimensions on the inside of the body. There also can be one or more angled rings (barb like) that easily allows the plunger to be fitted and activated, but does not allow the invention to be disassembled. On the upper portion rim area of the body there can be holes for product flow, if desired, or no holes at all, forcing the product to flow through the bottom of the body, upwards, through the plunger.

Referring now to FIG. 2, a line of weakening 112 is shown. The line of weakening 112 can be broken by way of pull mechanism or other mechanisms shown. The line of weakening is slightly higher than the bottom of the invention; thus allowing a seal to be placed on the bottom of the invention, if desired. Absorbent seal 113 holds the bottom closure in place. On both pieces of the invention can either be a flat surface 114 or two raised areas, like a ring type, that an absorbent seal can be adhered to. Can have an area so whereby a pull type mechanism 115 can stay in the area which is desired so the pull wont move or bend, so it will ensure a good dispersement and full opening on the bottom of the product. Flanges, flashes, featherings 116 can be located under the top rim of the invention for it to be able to fit snuggly into the inside diameter of a container.

Another embodiment of a rim type 117 allows the invention to tightly fit against the inside diameter of a container it is to be placed in. In this case flanges 116 would not be needed.

One or more open areas 118 allow for liquid flow. They would not be needed if the top portion of the invention has one or more holes to allow the liquid to flow through after activation. Can have one or more openings 119 which can include a screen, mesh type cover, to allow liquid to flow through.

Referring now to FIGS. 3 and 4, FIG. 3 shows the plunger having air vents running up and down on the outer side walls that are indented until the first seal ring 3 and 4, to allow air escape during assembly of the invention after product is filled. The bottom of the plunger is angled with a tip at the longest portion of the angle 20, to allow an easy opening when activated 20. After activating, if desired, the plunger can have a line of weakening, breakaway seal 5, and turns into a piston like device; when activated the plunger bottom opens the body 23A and 24, which can be better referenced in 22A and 23, and the bottom remains affixed to the bottom rim area with flanges/flashes 23, not allowing the bottom portion to fall into the container after final activation. One or more seal rings that can be molded into the plunger or, if desired, double molded with a different type of material, that can be expandable to secure an airtight unit until ready to use 26. Also having one or more seal rings that could be angled not to allow the product to be disassembled by an individual. One or more safety seals containing absorbent materials, like desiccant, natural and/or synthetic, can be applied at any location inside or outside 28, to allow moisture to absorb for better securing the ingredients inside for longer stability. This is very important, especially in humid areas throughout the World.

FIG. 4 shows the body having air vents on the outside 8A and 22, to allow air or gasses to escape while applying into a container. The body of the invention can be separate as shown in this FIG. 4, it also can be molded in one or more pieces, as shown in FIG. 1; and also allowing a rim 21 that can, with fluid release holes or without, rest on the upper lip of a container, or be slightly tapered or indented 43 and 44. Also the upper rim portion can be angled with a flanged fit towards the top, that would match a perform/container after blown, to fit snuggly in place 43, 29, and 44. The upper rim area on the body can have holes or no holes 21, and angled flanges 21A, to allow the invention to fit snuggly in a container, depending on the inside diameter of the container.

FIG. 3 shows an upside-down exploded side view of the plunger mechanism with the bottom portion being angled, with a start tip point, so that when a person manually activates the invention, it's easier to start the opening of the body, FIG. 4. The plunger mechanism also has, running up and down, slight indentations designed for venting air so the invention does not build up with pressure during assembly filled with ingredients and for an easier activation. The invention has one or more seal rings located on the upper area of the outside plunger along with one or more angled rings for a one way click-in type fit thus allowing the product to have less moisture and not allowing an individual to disassemble the invention. On the top portion of the plunger there are one or more holes that can have slightly raised areas around each hole and the outer portion on top of the plunger and on the top portion of the body all being the same height so a safety seal, preferably with an absorbent material, can be attached to ensure the efficacy of the ingredients stored in the invention.

FIG. 4 shows an upside-down exploded front view of the body lip portion, which fits on a container, can either have holes for flow of products after activation, or no holes, to force the product to flow through the bottom of the body through the plunger with open holes. On the outside of the body there can be indentations made for venting to allow air or gases to escape while invention is inserted into a container. On the bottom of the body around portions of, or the entire area of the bottom body, there can be a line of weakening that would match the plunger mechanism body. Around the line of weakening there can be flanges/flashes, or hinge type raised or indented areas, so that when the invention is activated the so called flanges are close enough together that some would stay attached to the bottom portion of the body, not allowing the open bottom to fall into the container. When activated the last area of angle on the bottom portion of the plunger will go past the bottom rim of the body, forcing the bottom to stay open, allowing all the ingredients inside to fall into the container without having the product stick, due to the bottom not opening correctly, as shown in FIG. 23A. There can be a seal, pad, or pouch type of an absorbent that can be placed and/or adhered at any location on the inside of the invention to absorb moisture.

The plunger mechanism 120 can have one or more points to easily start the opening of the bottom of the body. Can have no holes or holes 121 that will allow liquid flow. Can have outside vents 122 in the body of the invention to allow air to escape when inserted into a container. Can have flanges or flashes 123 close enough together to allow the portion that is opened after activation to stay attached to the outside body below; as shown in 123A. The activator mechanism 124 after activating the invention will travel further past the opening of the bottom to ensure a complete open for product dispersement; not allowing the bottom to flap over the activator. Rim 125 fits snugly in a click-in position to allow an air-tight seal. Activator can have one or more seal rings 126 that will have the reverse fit in the body in the closed position and also in the activated, post position. One or more of the rings can also have a one-way barb-like angle, not allowing the activator to disassemble after being sealed. Air vents 127 can be different sizes to allow air to escape while assembling the invention. An absorbent type pad/seal 128 can affixed to any portion of the invention to allow moisture absorbent to keep the ingredients inside fresher. A preformed bottle can have a step type design 129 in the rim so that the invention can rest on the inside portion of the neck bottle so the invention can remain at the same height as the upper surface area of a bottle.

FIG. 5 shows an exploded perspective view, looking down, an area to start a rip portion of the bottom seal. Also it shows a hinged mechanism whereby the bottom stays attached to the body, after activation, with the line of weakening that opens the bottom evenly.

FIG. 5A shows an exploded, sliced, internal view of a screw cap type mechanism, with the safety seal, that a body of the invention is manufactured as one piece with the plunger mechanism being attached after it's filled with a product. A pull like device can start the opening on the bottom by pushing the top portion of the plunger, and then an individual can use the invention by means of a push-pull, twist, or flip-cap style opening. The invention can also have a dust cover with safety seals, that can be turned upside-down, and utilize the flat surface area for activation so that an individuals contaminated finger does not need to be placed on the plunger mechanism. Also imbedded on the cap or anywhere on the invention, as described earlier, an RFID chip, barcode like device, or any other type of information type device can be part of the invention. An seal or an absorbent type pad that can be coated or imbedded with an absorbent to allow less moisture in the ingredients stored, which can be placed at any location inside the invention.

FIG. 5 shows a molded portion 130 that is angled to start the opening of the bottom which can include a line of weakening. A hinge area 131 can be located right above the bottom of the body that allows the bottom to stay attached to the body after activation. Line of weakening area on the bottom of the invention. A seal 132 can also be attached on the bottom for insurance of keeping the ingredients inside fresh. An absorbent seal 133 can also be placed any location inside the invention. A pull like device 134 that is connected from the bottom, that, once depressed from the top, pushes force to the below line of weakening to release the ingredients stored inside. One-way barbs 135 so the invention cannot come apart after sealed with ingredients. A dust cover 136 that can be removed and turned upside down to activate the invention. Can have a push-pull, twist, applicator, flip-top, spill-proof, and/or other types of flow able mechanisms 137. Can have screw, snap-on, straight edges for ultra-sonic sealing, and other type attachments for containers 138, including but not limited to: pouches, cartons, cans, drums, totes, and bottles.

Figure 6:
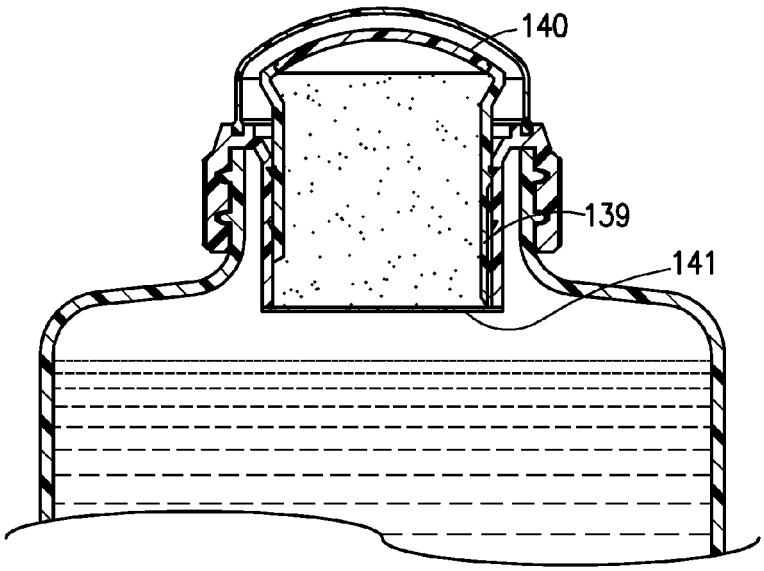
FIG. 6 is a side elevational view in cross section through the vertically disposed plane through the center of another embodiment of the cap affixed to a container.

FIG. 6 shows a sliced front view of the body of the invention that is part of a screw-on or snap-on type closure, with the top having an open area so the product can be filled and then with the cap seal portion being snapped firmly into place. The opening of the bottom is made in an angle position similar to that of Figure three, and can have either a line of weakening bottom that is part of the body mold and/or an absorbent seal.

Figure 7:
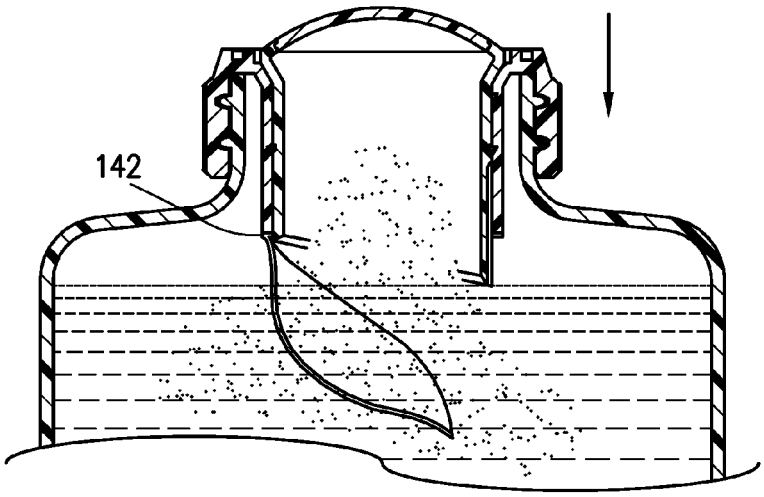
FIG. 7 is a side elevational view in cross section through the vertically disposed plane through the center of another embodiment of the cap affixed to a container after the plunger has pierced the seal holding the chemically reactive agent contained in the cap.

FIG. 7 shows a front sliced view of the last area of the angled bottom after activated goes past the bottom of the body to ensure a full displacement of the ingredients into a container.

Referring now to FIGS. 6 and 7, the cap can have one or more angles 139 to open the bottom of the invention to allow ingredients to go into a container. Can have a click-in top 140 so, if desired, can be filled with ingredients, then sealed. Can have a absorbent seal-like bottom 141 or can also be made in one piece with the line of weakening as shown in 132 and 131A. After activated the smallest area of the activator 142 will go past the bottom of body.

Figure 8:
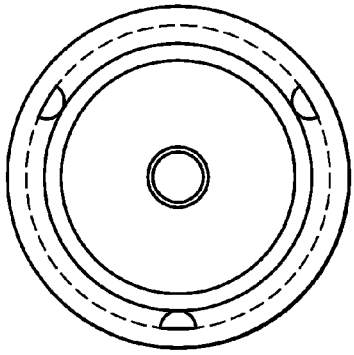
FIG. 8 is a top view of another embodiment of the container cap.
Figure 9A:
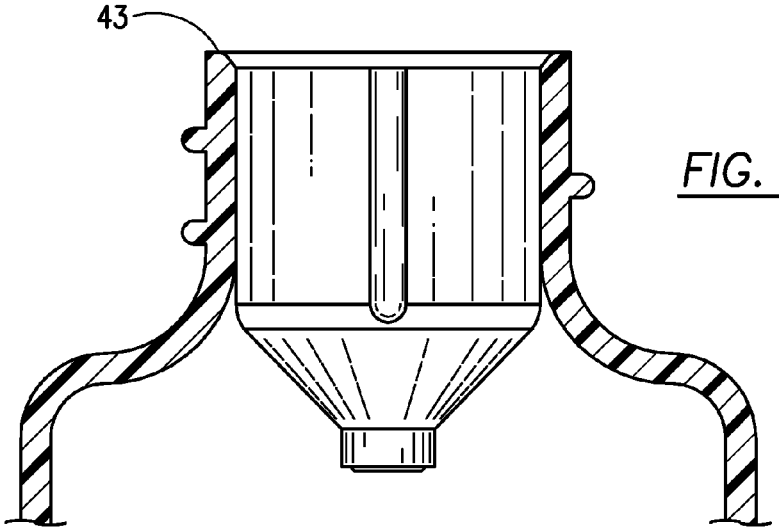
FIG. 9A is a side elevational view of another embodiment of the container cap disposed within a sectional of a container.
Figure 9B:
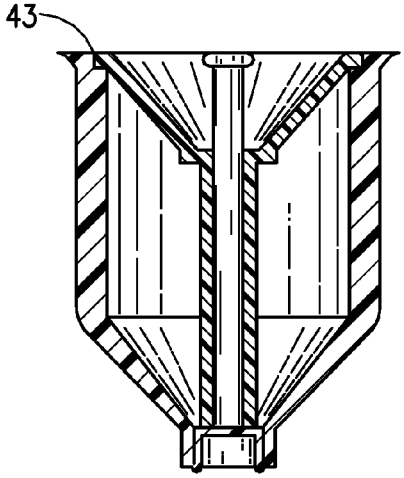
FIG. 9B is a side elevational view in cross section through the vertically disposed plane through the center of yet another embodiment of the container cap.
Figure 9:
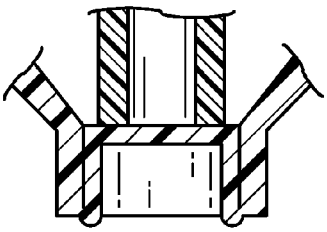
FIG. 9 is a close up view partially cut away showing the seal of the cap of FIGS. 9*a* and 9*b* in greater detail.

Referring now to FIGS. 8 and 9, FIGS. 8 and 9 show the top view and sliced, side view of the body of the invention that can be angled outward on the top portion of the rim area, without flanges or flashes, to be able to snuggly fit into a chamber, remaining flush with the upper rim portion or a container.

FIG. 8A shows an exploded front sliced view. The body of the invention can have an upward flange angle outward, with the upper rim of a container having the reverse fit on the inner portion of the surface area.

FIGS. 9, 9*a*, and 9*b* show an alternate embodiment of the present invention. FIG. 9 shows an exaggerated front sliced view bottom portion of a plunger that can be tightly fitted in with the body of an invention, so that when activated it allows the product to flow into a container in a funnel like position.

Figure 10:
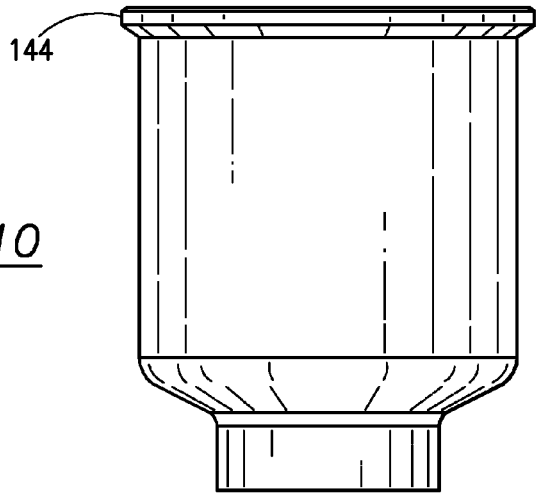
FIG. 10 is a side elevational view of yet another embodiment of the container cap.
Figure 11:
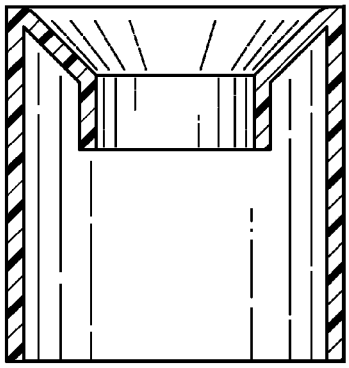
FIG. 11 is a side elevational view in cross section through the vertically disposed plane through the center of the inner body of the embodiment of the cap shown in FIG. 10.
Figure 12:
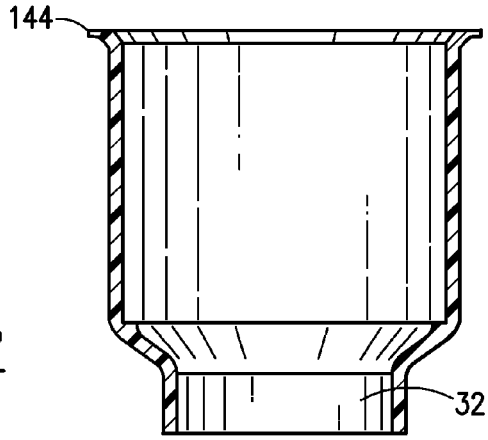
FIG. 12 is a side elevational view in cross section through the vertically disposed plane through the center of the outer body of the embodiment of the cap shown in FIG. 10.

FIGS. 10, 11, and 12 show exploded perspective views from the front and sliced views of other designs that can be clicked in or forced in with a tight fit as described further in FIG. 8A. Referring now to FIGS. 10, 11 and 12, an alternate embodiment is shown. This embodiment contains a flange fit top 144 is used to mount the container cap on top of the target container. FIG. 11 shows an upper side view angle of a twist cap 31 that is attached to the spike 32 to start and stop flow of a liquid. On the circumference of the outside spike an angled ring area on FIG. 9A acts as a seal ring as does FIG. 8 but, once assembled, cannot be taken out by an individual. These seal rings can help prevent moisture or air getting in or out of the invention. Towards the bottom of the spike a venting system 4 is indented to allow air to escape during assembly of the product, and for easier activation. When ready to activate the angled area 5 on the bottom of the spike can first start the ripping motion.

Figure 13:
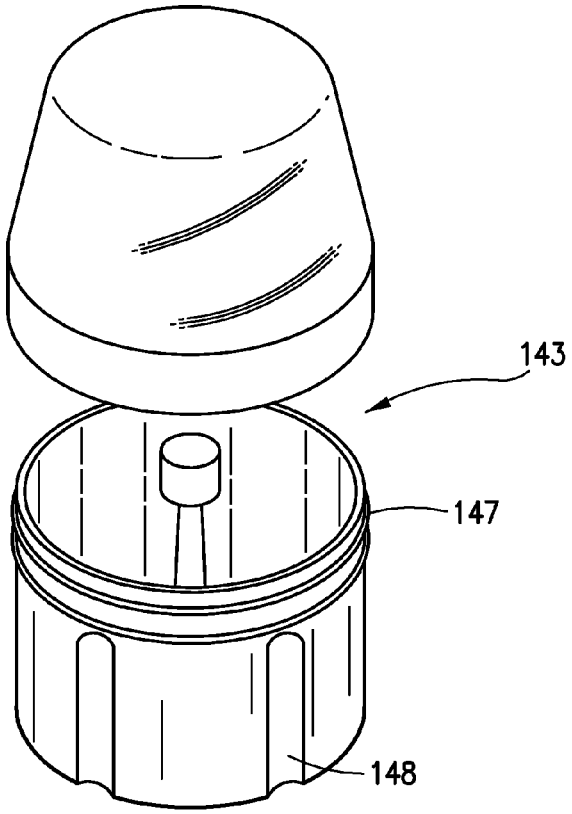
FIG. 13 is a perspective view of a plunger mechanism that can have an applicator tip.

FIG. 13 shows an exploded perspective view of a plunger type mechanism with an opening throughout areas of a plunger that can have an applicator type tip for precise application of use such as: hair care, eyes, acne, glue spots, and others that can be fitted into any type of body including similar to FIG. 10.

Referring now to FIG. 13, seal rings and/or angled barbs 147 are also found in the chamber of the container cap 146. In addition, air vents 148 are used as part of a ventilation system.

FIG. 14 shows a view of the body and plunger with the line of weakening. The body can have an open bottom that can be sealed with an absorbent normal seal, but preferably the bottom would be one piece molded to the body, with the line of weakening throughout the entire bottom area with the flanges to support the bottom from falling into the container after activated. The line of weakening 49 can have an absorbent seal on the inside or outside 50, or any other location attached to the invention.

FIG. 15 shows the plunger mechanism, if desired, can have one or more holes on the top with raised areas around each hole 50A, as well as on the outside portion of the plunger 50C, that all would match the even height of the seal ring of 50D. The upper lip portion of the body can have holes located. Looking down at the invention from the top, shows the plunger mechanism and body that can have open areas for flow, or not, around the upper rim of the body, and shows the plunger mechanism that can have one, or more, holes for flow of liquid.

Referring now to FIGS. 14 and 15, the container cap bottom has line of weakening 149. An absorbent seal 150 on the bottom of the container or on the inside at any location of the invention.

FIG. 16 shows a view of the body with air vents and flanges under the upper rim portion. The outside portion of the body running up and down, or any direction desired, 52, can allow air to escape while applying the invention into the container. Once in a container flanges 52A can help support and stabilize the invention in a container. Also the invention can have an outward angle towards the top of the body to easily fit into position in the neck of container. All of these inventions in this application can easily be adapted with little modification to fit any type or style container including for pouch fitments, carton fitments, bottle fitments, can fitments, drum fitments, and more.

FIG. 17 shows a front view of the body and angled plunger.

FIG. 18 shows a view from the top and side of the body of the invention, and the plunger, with the venting system, seal rings, barb rings, and holes for liquid flow.

FIG. 19 shows a view of how the invention can be placed into a bottle, resting on an indenting ledge as better shown and described in FIGS. 8A, 10, 11, and 12.

FIG. 20 shows a view of the plunger and body, with the pull that can break the line of weakening on the bottom of the body to allow product to be released.

throughout the top, with supporting flanges underneath between the openings 50E.

Referring now to FIGS. 16, 17, 18, 19, and 20, the invention is shown fitting snugly flush with the top edge of a container 151. Can have air vents 152 on the outside of the body so while installing the product in a container of any type it can allow air flow to escape without pressure. Can have one or more holes 153 in the top portion to allow sufficient liquid flow. One or more seal rings 154. Air vents 155 to allow air to escape. Can have an angled portion activator 156 to start the bottom rip of the line of weakening and/or absorbent seal. Can have an absorbent seal 157 located anywhere on the inside of the invention. Can have one or more holes 158 to put force on the bottom to open the container.

Figure 21:
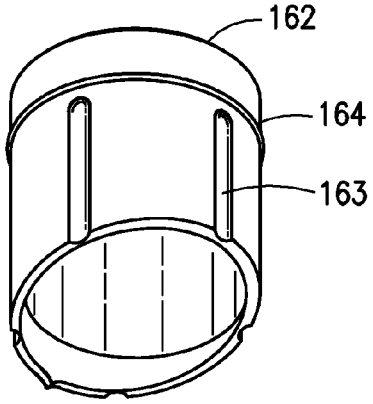
FIG. 21 is a perspective view of the plunger of yet another embodiment of the container cap including air vents.

FIG. 21 shows a front perspective view of the plunger mechanism that is angled with the starting point, opening, air vents, ring seals, and one-way barbs.

Figure 22:
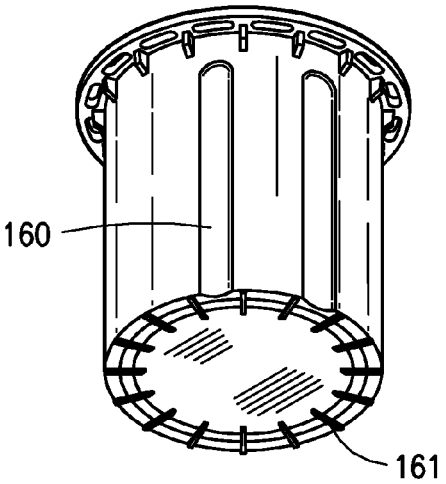
FIG. 22 is a perspective view of the outer body of yet another embodiment of the container cap including air vents.

FIG. 22 shows view of the body that can be angled outwards towards the top to fit snuggly into a neck of a container, along with bottom flanges and lines of weakening so the bottom stays attached to the body after activation and shows outside air vents.

Figure 23:
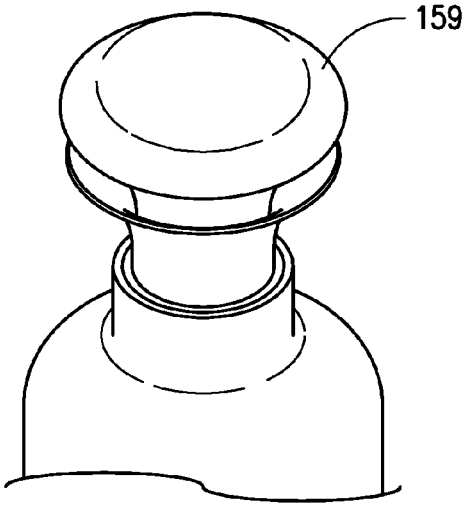
FIG. 23 is a perspective view of yet another embodiment of the container cap with a bubble for holding a greater amount of chemically reactive agent in the cap.

FIG. 23 shows a view that the upper portion of the plunger can have a bubble type shape towards the top to allow more product to be stored by having a smaller container size on the bottom.

Figure 24:
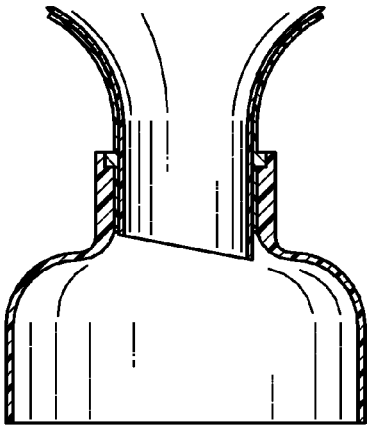
FIG. 24 is a close up side elevational view showing the cap after the plunger has been pushed downwardly within the outer body of the cap.

FIG. 24 shows a view of, when the plunger is depressed, the final stop position of the last upper area of the angled bottom area of the plunger goes further past the bottom of the body, thus allowing the bottom opened portion that stays attached to the body, after activation, to keep out of the way, for no interference with the product contained inside the invention from dispersing.

Referring now to FIGS. 21, 22, 23, and 24, the activator 159 can be also larger on top to allow more product to be stored in the invention. Outside air vents 160 to allow air to escape while inserting into a container. Flashes/flanges 161 to allow the bottom to stay attached to the body after activation. A click-in ridge 162 on top of the invention. Air vents 163 in the activator to allow air to escape. Seal rings 164 and one-way barbs are also shown.

Fluorination can be done to the product to better coat the invention for better barrier protection properties as well.

A one or more moisture and/or coating materials/ingredients can be added in to the product at manufacturing to allow better stability of ingredients to remain stable longer. It acts like a repellant for liquid or powder Absorbent or desiccant type material (seal, pad, pouch, adhered to, and/or added to the rein or material in manufacturing) can be added to the invention to and at any location of the invention to assure moisture absorbent to better the quality of the ingredient to the invention.

An RFID chip, tag, or nano ID can be attached during or after manufacturing for tracking and information to better insure safety, security and forms of information.

Bar codes can be molded in the invention or applied during or after manufacturing process for all forms if information In the plunger and/or body of the invention there are slight indentations of the body (ies) running up and down and in some cases sideways to allow air to escape while assembling the pieces together after for a quicker production and fresher product One or more male and female seal rings, flanges, flashes are around the circumference either on the plunger or body or both to allow an air tight seal along with a stop point for the final stage after filling the invention with a product The invention can be made of recyclable material such as from corn or other bio degradable materials The invention can also have added to the resin and/or metal (which ever is desired) a anti bacterial type agent for killing or help eliminate germs and bacteria from forming such as triclosan or other natural and/or synthetic materials, making the invention a more stable and safe product.

The invention can be modified to fit any place on a container than just a standard opening. It can be affixed also on any location of a container than just the standard opening including having the chamber portion either molded in a container or having an additional area where to add the invention so the normal opening can remain the same.

Micro encapsulation can be added to the invention to automatically change colors to let a person know the temperature of the product for reasons for safety, temperature, purity, and directly from the correct source and not from a knock off company.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A storage and release cap for insertion within a liquid or powder holding target container, for containing at least one substance to be dispensed into the container comprising, said cap comprising:

a cap bottom portion having a hollow body that is impermeable to liquid or gas and configured in any shape to fit within an opening of a targeted container, said bottom portion having a top receiving end and an bottom dispensing end;

said bottom dispensing end having a sealed bottom closure with a line of weakening;

a plunger mechanism having an elongated portion that is between a sealed bottom closure with a line of weakening and a closed top portion, creating a sealed interior chamber, wherein said elongated portion is sized to slidably fit within the hollow body of said bottom portion and said top portion is sized to fit around the rim of the top receiving end;

said plunger mechanism located within said bottom portion;

a rigid cover portion removably positioned on top of and sized to completely cover the top receiving end of the bottom portion and the top portion of the plunger mechanism;

wherein the cap is manually activated when downward manual force is applied to the plunger mechanism;

where downward manual force on the plunger mechanism engages and displaces the sealed bottom closure of the plunger mechanism and causes said elongated portion to extend vertically downward, engaging and displacing the sealed bottom closure of said release cap into a position that causes a substance or substances stored within said chamber to be released into the container below; and a storage and release cap wherein said bottom portion additional includes a venting system of one or more indented areas running vertically along the exterior wall of the body of the bottom portion for release of air and gas build-up.

2. The storage and release cap of claim 1, wherein said cap additionally includes including one or more corresponding pairs of interlocking male seal ring mechanisms, each ring mechanism having a ring running horizontally around the inside circumference of the bottom portion and an opposing cavity in the outside circumference area of the plunger mechanism.

3. The storage and release cap of claim 1, wherein said cap additionally includes including one or more corresponding pairs of female interlocking seal ring mechanisms, each ring mechanism having a cavity running horizontally around the inside circumference of the bottom portion and an opposing ring on the outside circumference area of the plunger mechanism.

4. The storage and release cap of claim 1, wherein the top portion of the plunger mechanism has a substantially flat surface relative to a horizontal plane of the top receiving end.

5. The storage and release cap of claim 1, wherein the top portion of the plunger mechanism has an indented surface relative to a horizontal plane of the top receiving end.

6. The storage and release cap of claim 1, wherein the top portion of the plunger mechanism has a raised surface relative to a horizontal plane of the top receiving end.

7. The storage and release cap of claim 1, wherein the top portion of the plunger mechanism includes one or more openings.

8. The storage and release cap of claim 1, wherein the plunger mechanism additionally includes a removable absorbent tip.

9. The storage and release cap of claim 1, wherein the top portion of the plunger mechanism extends horizontally beyond the exterior wall of said plunger mechanism.

10. The storage and release cap of claim 1, wherein the line of weakening sealed bottom closure of the bottom dispensing end includes one or more hinges for sealing a closure to the bottom of the bottom portion.

11. The storage and release cap of claim 1, wherein the line of weakening sealed bottom closure of the bottom dispensing end is secured with an adhesive absorbent seal.

* * * * *